US006402480B1

(12) United States Patent
Sud et al.

(10) Patent No.: US 6,402,480 B1
(45) Date of Patent: Jun. 11, 2002

(54) LUBRICATION PASSAGE FOR SWASH PLATE TYPE COMPRESSOR

(75) Inventors: Lavlesh Sud, Farmington Hills; Vipen Khetarpal, Novi; Shane A. Harte, Farmington Hills; David H. Herder; Yong Huang, both of Plymouth, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/747,624

(22) Filed: Dec. 22, 2000

(51) Int. Cl.[7] ..... F04B 1/26; F04B 1/12; F01M 1/00

(52) U.S. Cl. ..... 417/222.1; 417/269; 184/6.17

(58) Field of Search ..... 417/222.1, 269; 184/6.17

(56) References Cited

U.S. PATENT DOCUMENTS 4,142,450 A * 3/1979 Thoma ..... 91/485
4,174,191 A * 11/1979 Roberts ..... 417/222
4,178,135 A * 12/1979 Roberts ..... 417/222
4,478,134 A * 10/1984 Kawahara et al. ..... 91/488
5,088,897 A 2/1992 Kawai et al. ..... 417/269
5,178,521 A 1/1993 Ikeda et al. ..... 417/269
5,181,834 A 1/1993 Ikeda et al. ..... 417/269
5,378,115 A * 1/1995 Fujii et al. ..... 417/269
5,586,870 A 12/1996 Kawaguchi et al. ..... 417/222.2
5,603,610 A 2/1997 Kawaguchi et al. ..... 417/222.2
RE35,672 E * 11/1997 Taguchi ..... 417/222.2
5,779,004 A 7/1998 Hoshino et al. ..... 184/6.17
5,785,502 A 7/1998 Ota et al. ..... 417/222.2
5,871,337 A * 2/1999 Fukanuma et al. ..... 417/222.2

* cited by examiner

*Primary Examiner*—Charles G. Freay
*Assistant Examiner*—Timothy P. Solak
(74) *Attorney, Agent, or Firm*—Larry I. Shelton

(57) ABSTRACT

A variable displacement swash plate type compressor which incorporates a lubrication passage formed in the drive shaft, wherein the lubrication passage provides fluid communication between a discharge chamber and a crank chamber. The lubrication passage maximizes the low of refrigerant gas and lubricating oil to the crank chamber under all operating conditions providing cooling and lubrication to the internal moving components in the crank chamber. The lubrication passage facilitates the efficient flow of lubricating oil from the discharge chamber to the crank chamber.

4 Claims, 5 Drawing Sheets

LUBRICATION PASSAGE FOR SWASH PLATE TYPE COMPRESSOR

FIELD OF THE INVENTION

The present invention relates to a variable displacement swash plate type compressor adapted for use in an air conditioning system for a vehicle, and more particularly to a compressor having a passage in a drive shaft for providing lubricating oil to the crankcase.

BACKGROUND OF THE INVENTION

A typical conventional variable displacement swash plate type compressor includes a cylinder block provided with a number of cylinders, a piston disposed in each of the cylinder of the cylinder block, a crankcase sealingly disposed on one end of the cylinder block, a cylinder head sealingly disposed on the other end of the cylinder block, a rotatably supported drive shaft, and a swash plate. The swash plate is adapted to be rotated by the drive shaft. Rotation of the swash plate is effective to reciprocatively drive the pistons. The length of the stroke of the pistons is varied by the inclination of the swash plate. Inclination of the swash plate is varied by controlling the pressure differential between a suction chamber and a crank chamber. The pressure differential is typically controlled using a control valve and a conduit formed within the cylinder block which provides fluid communication between a discharge chamber and the crank chamber to convey compressed gases from the discharge chamber to the crank chamber based on the pressure in the suction chamber. The conduit also typically provides communication for lubricating oil between the discharge chamber and the crank chamber to achieve lubrication of the moving components within the crank chamber.

Another conventional lubricating system disclosed in the prior art employs a forced lubrication system including an oil pump provided at one end of the drive shaft and driven by the drive shaft to lubricate the moving components within the crank chamber. The forced lubrication system typically causes lubricating oil to be pumped from an oil sump, through a pump chamber, a lubrication passage and radial branch passageways within the drive shaft, to the crank chamber.

The compressor arrangements in the prior art described above have several disadvantages. First, when a compressor having a conduit within the cylinder block is operating at minimum capacity, ineffective lubrication of the close tolerance moving parts within the crank chamber occurs due to the lack of consistent flow of refrigerant gas from the discharge chamber to the crank chamber. Second, in a compressor having a forced lubrication system, the compressor may include an oil sump, a pump chamber, and an oil pump operatively connected to the drive shaft adding expense.

An object of the present invention is to produce a swash plate type compressor wherein oil flow to the crankcase during both minimum and maximum operating conditions is improved to result in efficient lubrication of the compressor components.

Another object of the present invention is to produce a swash plate type compressor wherein the oil sump, the pump chamber, and the drive shaft driven oil pump of the prior art can be eliminated.

SUMMARY OF THE INVENTION

The above, as well as other objects of the invention, may be readily achieved by a variable displacement swash plate type compressor comprising: a cylinder block having a plurality of cylinders arranged radially therein; a piston reciprocatively disposed in each of the cylinders of the cylinder block; a cylinder head attached to said cylinder block and having a discharge chamber formed therein; a crankcase attached to the cylinder block to define a crank chamber; a drive shaft rotatably supported by the crankcase and the cylinder block; a swash plate adapted to be driven by the drive shaft and having a central aperture for receiving the drive shaft, radially outwardly extending side walls, and a peripheral edge; and a lubrication passage formed within the drive shaft providing fluid communication between the discharge chamber and the crank chamber.

BRIEF DESCRIPTION OF THE DRAWINGS

The above, as well as other objects, features, and advantages of the present invention will be understood from the following detailed description of the preferred embodiment of the present invention with reference to the accompanying drawings, in which.

DETAILED DESCRIPTION OF THE PREFERRED EMBODIMENT

Figure 1:
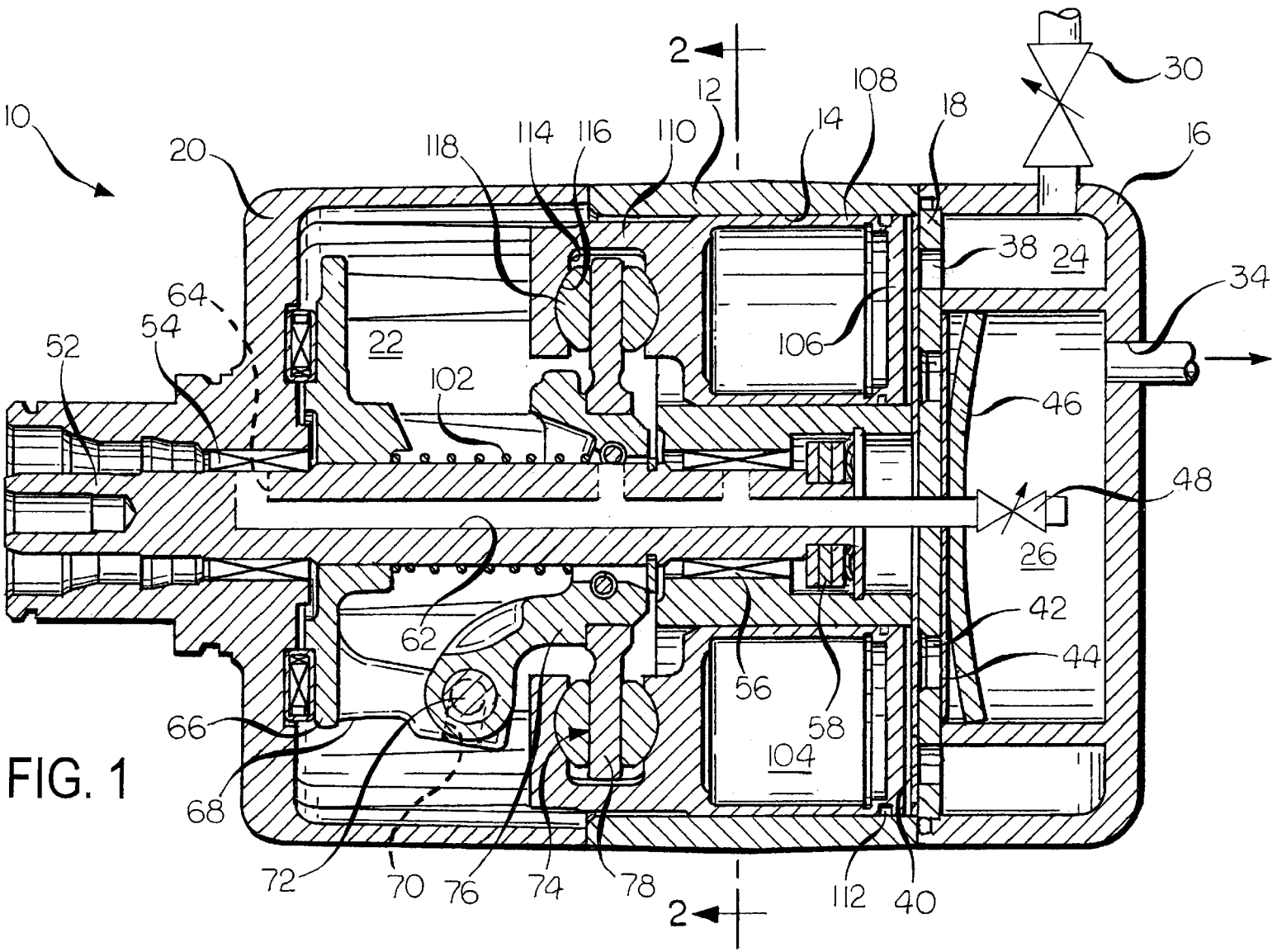
FIG. 1 is a cross sectional elevational view of a variable displacement swash plate type compressor incorporating the features of the invention, schematically showing a lubrication passage in the drive shaft in fluid communication with the discharge chamber and the crank chamber.
Figure 2:
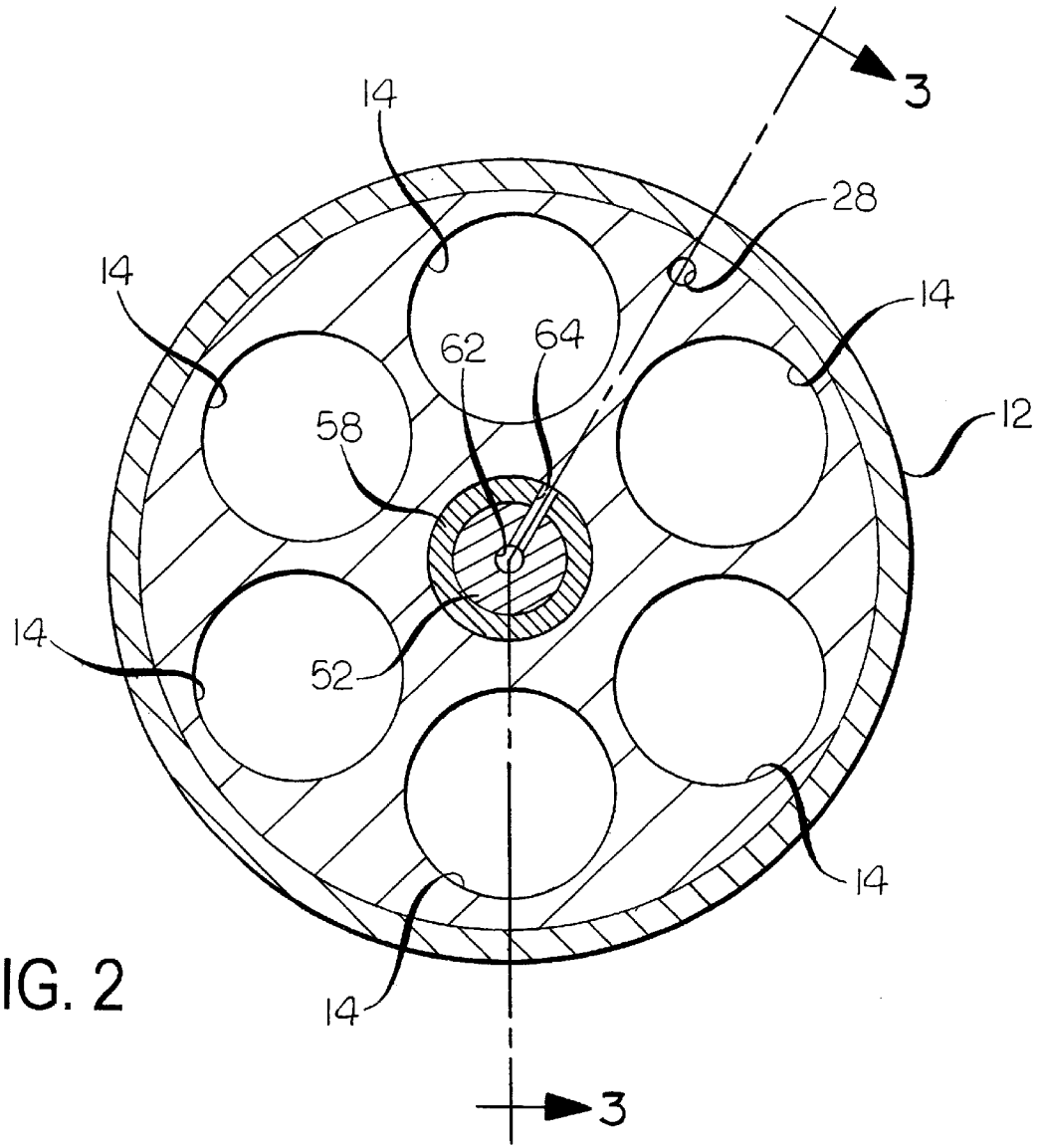
FIG. 2 is a cross-sectional view of the compressor illustrated in FIG. 1 taken along line 2—2 thereof, showing a first radial bore of the lubrication passage, and an orifice tube in the cylinder block in fluid communication with the crank chamber and the suction chamber.
Figure 3:
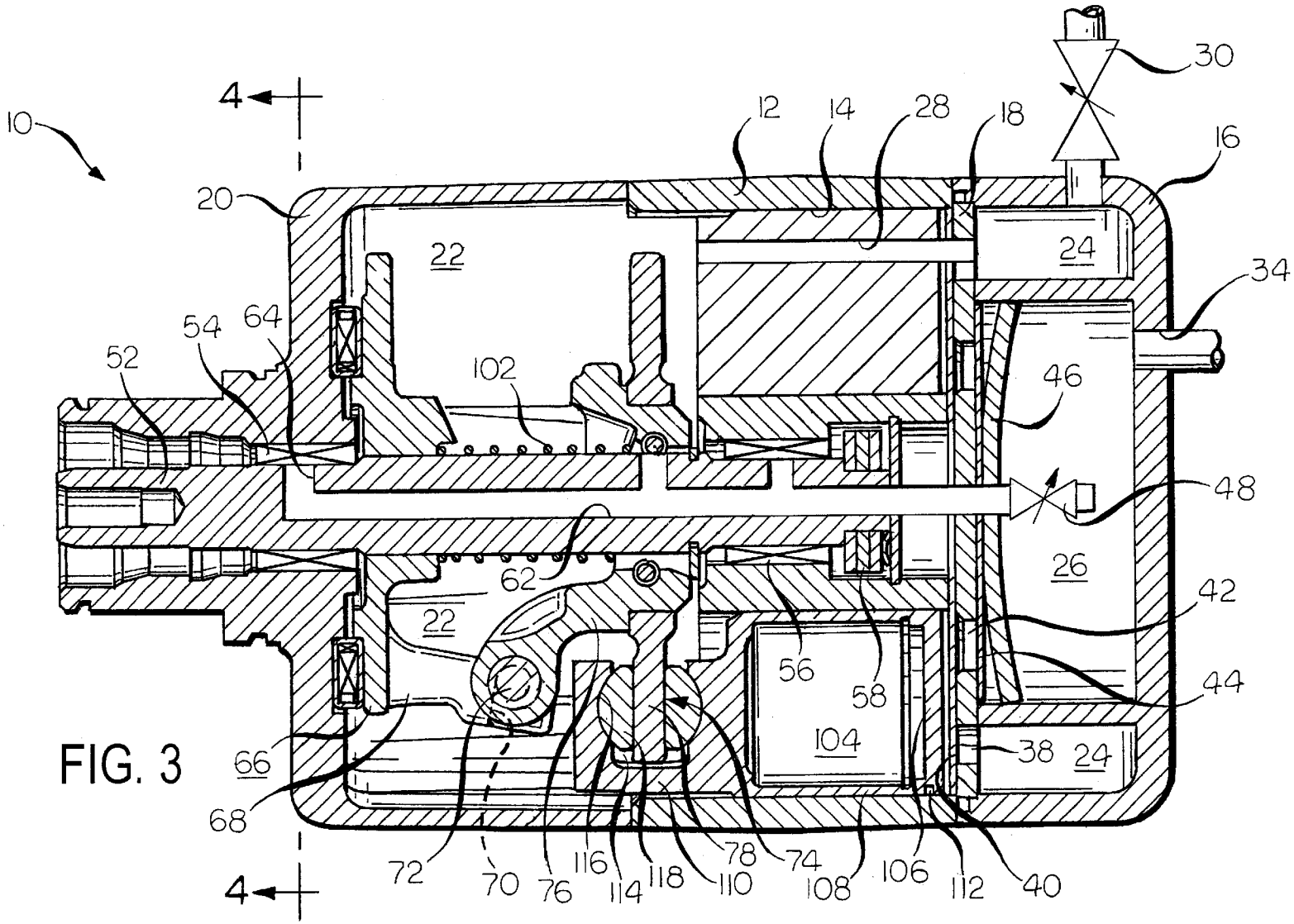
FIG. 3 is a cross sectional elevational view of the compressor illustrated in FIGS. 1 and 2 taken along line 3—3 of FIG. 2, schematically showing a lubrication passage in the drive shaft in fluid communication with the discharge chamber and the crank chamber, and an orifice tube in the cylinder block in fluid communication with the crank chamber and the suction chamber.
Figure 4:
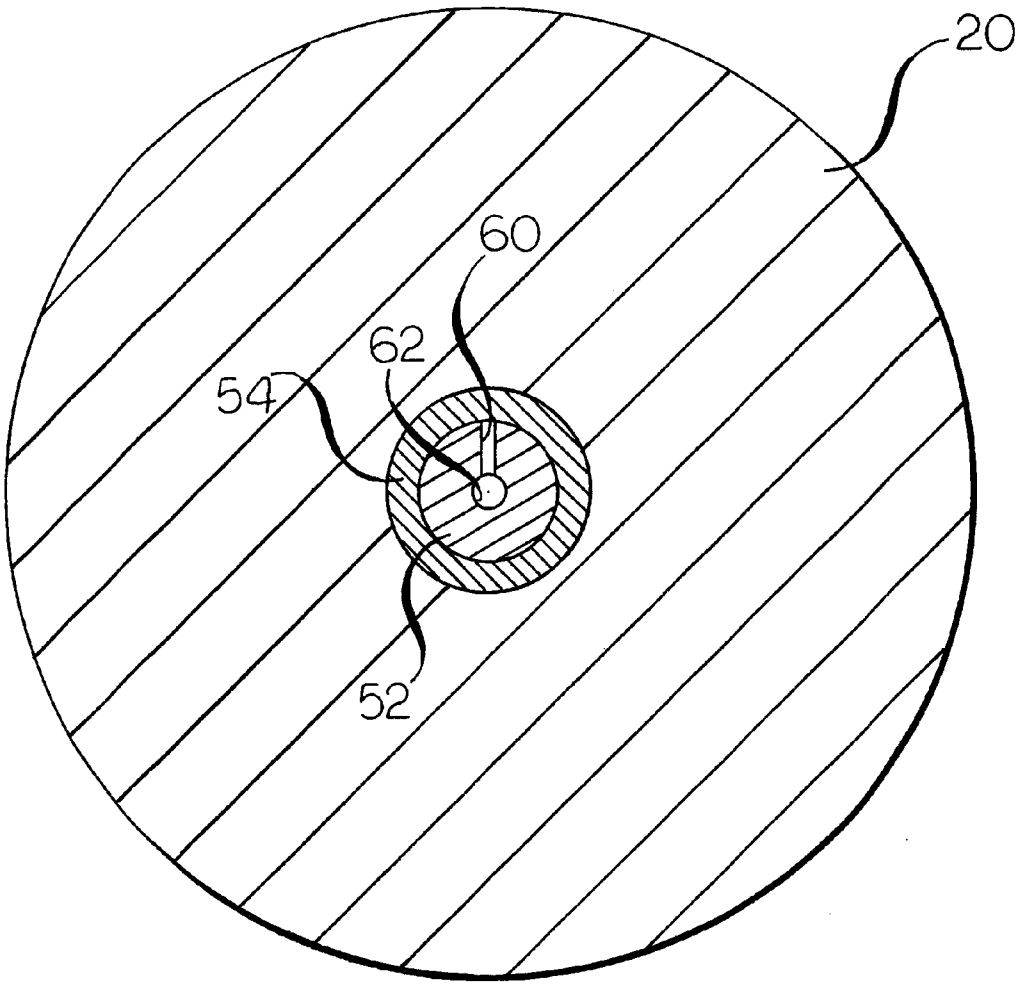
FIG. 4 is a cross-sectional view of the compressor illustrated in FIG. 3 taken along line 4—4 thereof, showing an additional radial bore of the lubrication passage.

Referring now to the drawings, and particularly FIGS. 1 and 3, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a suction chamber 24 and a discharge chamber 26. An orifice tube 28 is disposed to provide fluid communication between the crank chamber 22 and the suction chamber 24. A shut-off valve 30 provides selective fluid communication between an evaporator (not shown) of the cooling portion of the air conditioning system for a vehicle and the suction chamber 24. An outlet port 34 provides fluid communication between the discharge chamber 26 and the cooling portion of the air conditioning system for a vehicle. Suction ports 38 provide fluid communication between the suction chamber 24 and each cylinder 14. Each suction port 38 is opened and closed by a flap valve 40 which may be formed as an integral part of the valve plate 18. Discharge ports 42 provide fluid communication between each cylinder 14 and the discharge chamber 26. Each discharge port 42 is opened and closed by a discharge valve 44. A retainer 46 restricts the opening of the discharge valve 44.

An electronic control valve 48 is disposed in the discharge chamber 26 and arranged to monitor the discharge pressure of the compressor 10, the RPM of the vehicle engine, the humidity in the vicinity of the evaporator, and the like, to control the flow of refrigerant gas from the discharge chamber 26 to the crank chamber 22. The shut-off valve 30 is arranged to be actuated by the electronic control valve 48 through a fluid pressure channel (not shown), for example. In the embodiment shown, a mechanical shut-off valve is illustrated, but it is understood that other types of valves can be used.

A drive shaft 52 is centrally disposed in and arranged to extend through the crankcase 20 to the cylinder block 12. One end of the drive shaft 52 is rotatably supported by a bearing 54 mounted in the crankcase 20, and the other end of the drive shaft 52 is rotatably supported in a bearing 56 mounted in the cylinder block 12. Longitudinal movement of the drive shaft 52 is restricted by a thrust bearing 58 mounted in the cylinder block 12.

A longitudinally extending lubrication passage or bore 62 is formed within the drive shaft 52. The bore 62 communicates with a plurality of spaced apart radially extending bores 64. The lubrication passage 62 and the bores 64 provide fluid communication between the discharge chamber 26 and the crank chamber 22.

A rotor 66 is fixedly mounted on an outer surface of the drive shaft 52 adjacent one end of the crankcase 20 within the crank chamber 22. An arm 68 extends outwardly from a surface of the rotor 66 opposite the surface of the rotor 66 that is adjacent the end of the crankcase 20. A slot 70 is formed in the distal end of the arm 68. A pin 72 has one end slidingly disposed in the slot 70 of the arm 68 of the rotor 66.

Figure 5:
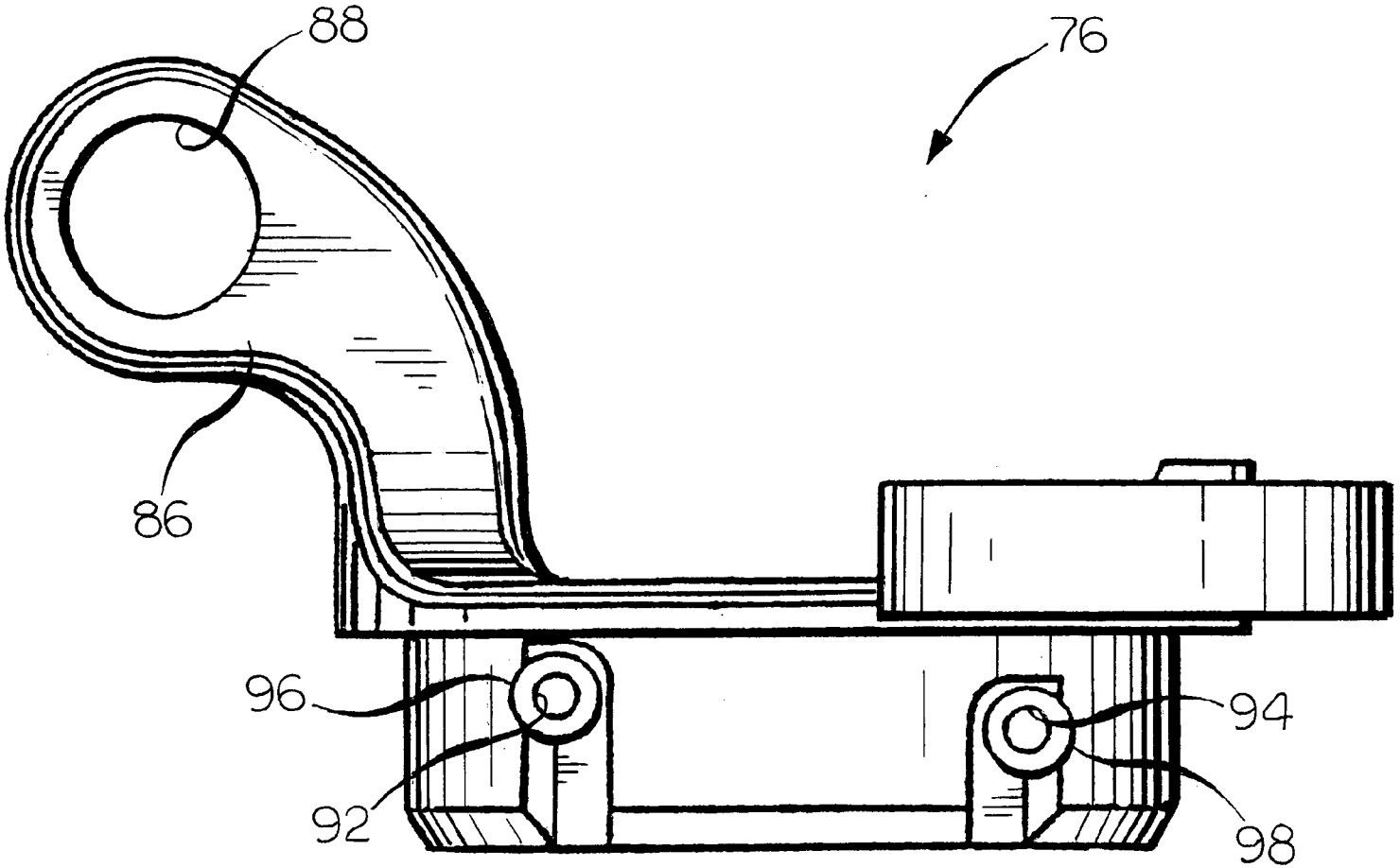
FIG. 5 is a elevational view of the hub of the swash plate illustrated in FIGS. 1 and 3 showing the features thereof.

A swash plate 74 is formed to include a hub 76 and an annular plate 78. Referring now to FIG. 5, the hub 76 includes a centrally disposed aperture formed therein and an arm 86 that extends outwardly and perpendicularly from the surface of the hub 76. An aperture 88 is formed in the distal end of the arm 86 of the hub 76. One end of the pin 72 is slidingly disposed in the slot 70 of the arm 68 of the rotor 66, while the other end is fixedly disposed in the aperture 88 of the arm 86.

A pair of spaced apart holes 92, 94 are formed in the hub 76 and are adapted to receive pins 96, 98, respectively which are typically press fit therein. The outer surfaces of the pins 96, 98 are formed to extend inwardly within the hub 76.

The hub 76 is press fit in a suitable central aperture of the annular plate 78. In the assembled form the drive shaft 52 is adapted to extend through the central aperture of hub 76.

A helical compression spring 102 is disposed to extend around the outer surface of the drive shaft 52. One end of the spring 102 abuts the rotor 66, while the opposite end abuts the hub 76 of the swash plate 74. The spring tends to urge the swash plate 74 away from the rotor 66.

A piston 104 is slidably disposed in each of the cylinders 14 in the cylinder block 12. Each piston 104 includes a head 106, a middle portion 108, and a bridge portion 110. A circumferential groove 112 is formed in an outer cylindrical wall of the head 106 to receive piston rings (not shown). The middle portion 108 terminates in the bridge portion 110 defining an interior space 114 for receiving the annular plate 78. Spaced apart concave pockets 116 are formed in the interior space 114 of the bridge portion 110 for rotatably containing a pair of semi-spherical shoes 118. The spherical surfaces of the shoes 118 are disposed in the shoe pockets 116 with a flat bearing surface disposed opposite the spherical surface for slidable engagement with the opposing sides of the annular plate 78.

In operation, the compressor 10 is actuated by the rotation of the drive shaft 52 which is typically an associated internal combustion engine of a vehicle. Rotation of the drive shaft 52 causes the simultaneous rotation of the rotor 66. The swash plate 74 is connected to the rotor 66 by a hinge mechanism formed by the pin 72 slidingly disposed in the slot 70 of the arm 68 of the rotor 66 and fixedly disposed in the aperture 88 of the arm 86 of the hub 76. As the rotor 66 rotates, the swash plate 74 is caused to rotate. During rotation, the swash plate 74 is disposed at an inclination. The rotation of the swash plate 74 is effective to reciprocatively drive the pistons 104. The rotation of the swash plate 74 further causes a sliding engagement between the annular plate 78 and the cooperating spaced apart shoes 118.

The reciprocation of the pistons 104 causes refrigerant gas and lubricating oil to be introduced from the suction chamber 22 into the respective cylinders 14 of the cylinder head 16. The reciprocating motion of the pistons 104 then compresses the refrigerant gas within each cylinder 14. When the pressure within each cylinder 14 reaches the pressure within the discharge chamber 26, the compressed refrigerant gas is discharged into the discharge chamber 26.

The capacity of the compressor 10 can be changed by changing the inclination of the swash plate 74 and thereby changing the length of the stroke for the pistons 104. The inclination of the swash plate 74 is changed by controlling the pressure differential between the crank chamber 22 and the suction chamber 24. The pressure differential is controlled by controlling the net flow of refrigerant gas from the discharge chamber 26 to the crank chamber 22 through the lubrication passage 62. As the piston 104 is caused to move toward a bottom dead center position, the pressure within the cylinder 14 is less than the pressure within the suction chamber 24. The suction valve 40 is opened causing refrigerant gas to flow into the cylinder 14 through the suction port 38. As the piston 104 is moved toward a top dead center position, the refrigerant gas within the cylinder 14 is compressed until the pressure within the cylinder 14 exceeds the pressure within the discharge chamber 26. The discharge valve 44 is then opened and refrigerant gas flows through the discharge port 42 to the discharge chamber 26.

The valve 48 controls the capacity of the compressor 10 by adjustably changing the flow of refrigerant gas and lubricating oil from the discharge chamber 26 to the crank chamber 22 through the lubrication passage 62 in the drive shaft 52. When an increase in thermal load occurs, the shut-off valve 30 is caused to open and the flow of refrigerant gas to the suction chamber 24 is increased, increasing the pressure therein. The pressure differential between the crank chamber 22 and the suction chamber 24 is therefore increased and the backpressure acting on the pistons 104 in the crank chamber 22 is decreased by bleeding refrigerant gas through the orifice tube 28. As a result of the decreased backpressure in the crank chamber 22, the pin 72 connecting the rotor 66 and the swash plate 74 is caused to move slidably and outwardly within the slot 70. The swash plate 74 is moved against the force of the spring 102, increasing the inclination of the swash plate 74, which increases the length of the stroke of each piston 104 and the compressor 10 is caused to operate at a maximum capacity.

Conversely, when a decrease in thermal load occurs, the shut-off valve 30 is caused to close and the flow of refrigerant gas to the suction chamber 24 is decreased, decreasing the pressure therein. The valve 48 is opened, causing refrigerant gas to flow from the discharge chamber 26 to the crank chamber 22 through the lubrication passage 62. The pressure differential between the crank chamber 22 and the suction chamber 24 is decreased, and the backpressure acting on the pistons 104 in the crank chamber 22 is increased. As a result of the increased backpressure in the crank chamber 22, the pin 72 is moved slidably and inwardly within the slot 70. The swash plate 74 yields to the force of the spring 102, the inclination of the swash plate 74 is decreased, and as a result, the length of the stroke of each piston 104 is reduced.

When the length of the stroke of each piston 104 is reduced, the compressor 10 is caused to operate at a minimum capacity. When operating at a minimum capacity and with the shut-off valve 30 closed, an internal refrigeration circuit is formed. Within the internal refrigeration circuit, refrigerant gas and lubricating oil are caused to flow serially from the suction chamber 24 to the cylinder 14, the discharge chamber 26, the valve 48, the lubrication passage 62, and the crank chamber 22, thus lubricating the component parts within the crank chamber 22. The refrigerant gas and lubricating oil in the crank chamber 22 is then caused to flow through the orifice tube 28 to the suction chamber 24, thereby completing the internal refrigeration circuit.

By introducing the refrigerant gas and lubricating oil from the discharge chamber 26 into the crank chamber 22 through the lubrication passage 62, instead of introducing the refrigerant gas from the discharge chamber 26 into the crank chamber 22 through the conduit of prior art, several benefits are achieved. The lubricating efficiency of the compressor 10 is maximized. The conduit within the cylinder block of prior art compressors causes the discharge chamber 26 to be in continuous fluid communication with the crank chamber 22. In the preferred embodiment of the invention, the flow of refrigerant gas and lubricating oil between the discharge chamber 26 and the crank chamber 22, through the lubrication passage 62, is controlled by the electronic control valve 48. The use of the electronic control valve 48 efficiently controls the flow of refrigerant gas and lubricating oil from the discharge chamber 26 into the crank chamber 22. The lubricating oil introduced into the crank chamber 22 through the plurality of spaced apart radial bores 64 provides lubrication to the components within the crank chamber 22. Further, when the compressor 10 is operating at a minimum capacity, it is not necessary to circulate the refrigerant gas through an external refrigeration circuit such as the air conditioning system for a vehicle. At such a minimum capacity, the electronic control valve 48 is caused to open and the shut-off valve 30 is caused to close, causing the refrigerant gas and lubrication oil to flow within the internal refrigeration circuit, thereby efficiently lubricating moving components such as bearings 54, 56, 58, and the swash plate 74. The introduction of lubricating oil to the crank chamber 22 improves the durability of the compressor 10.

Additionally, by introducing the refrigerant gas to the crank chamber 22 through the lubrication passage 62, as described above, the requirement an oil sump, a pump chamber, and a drive shaft driven oil pump is eliminated, thereby reducing manufacturing and operating costs.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable displacement swash plate type compressor comprising:

a cylinder block having a plurality of cylinders arranged radially therein;

a piston reciprocatively disposed in each of the cylinders of said cylinder block;

a cylinder head attached to said cylinder block and having a discharge chamber and a suction chamber formed therein;

a crankcase attached to said cylinder block to define a crank chamber;

an orifice tube formed in said cylinder block, said orifice tube providing fluid communication between the crank chamber and the suction chamber;

a drive shaft rotatably supported by said crankcase and said cylinder block;

a swash plate adapted to be driven by said drive shaft and having a central aperture for receiving said drive shaft, radially outwardly extending side walls, and a peripheral edge; and a lubrication passage formed within said drive shaft providing fluid communication between the discharge chamber and the crank chamber, wherein said lubrication passage includes a control valve for selectively opening and closing said lubrication passage.

2. The compressor according to claim 1, wherein said lubrication passage includes at least a first bore extending longitudinally within said drive shaft.

3. The compressor according to claim 2, wherein said lubrication passage includes at least one bore extending radially from said first bore portion.

4. A variable displacement swash plate type compressor comprising:

a cylinder block having a plurality of cylinders arranged radially therein;

a piston reciprocatively disposed in each of the cylinders of said cylinder block;

a cylinder head attached to said cylinder block and having a suction chamber and a discharge chamber formed therein;

a crankcase attached to said cylinder block and cooperating with said cylinder block to define a crank chamber;

an orifice tube formed in said cylinder block, said orifice tube providing fluid communication between the crank chamber and the suction chamber;

a drive shaft rotatably supported by said crankcase and said cylinder block and adapted to be coupled to an auxiliary drive means;

a rotor fixedly mounted on said drive shaft;

a swash plate adapted to be driven by said drive shaft and having a central aperture for receiving said drive shaft, radially outwardly extending side walls, and a peripheral edge;

hinge means disposed between said rotor and said swash plate to hingedly connect said rotor and said swash plate; and a lubrication passage formed within said drive shaft providing fluid communication between the discharge chamber and the crank chamber, said lubrication passage including at least a fit bore extending longitudinally within said drive shaft, and at least one additional bore extending radially between the first bore and the crank chamber of said crankcase, wherein said lubrication passage includes a control valve for selectively opening and closing said lubrication passage.

* * * * *